United States Patent [19]

Whitmore et al.

[11] Patent Number: 4,822,032

[45] Date of Patent: Apr. 18, 1989

[54] EXERCISE MACHINE

[76] Inventors: Henry B. Whitmore, Rte. 5, Box 369, San Antonio, Tex. 78211; Thomas P. Moore, Senate Blvd., Indianapolis, Ind. 46206

[21] Appl. No.: 42,211

[22] Filed: Apr. 23, 1987

[51] Int. Cl.[4] ..... A63B 69/06; A63B 23/04; A63B 21/22

[52] U.S. Cl. ..... 272/73; 272/72; 272/129; 272/132

[58] Field of Search ..... 272/73, 129, 132, 93, 272/DIG. 5, DIG. 6; 128/25 R

[56] References Cited

U.S. PATENT DOCUMENTS

| | | | |
|---|---|---|---|
| 3,162,783 | 12/1964 | Zozulin | 310/105 |
| 3,221,196 | 11/1965 | Henry-Baudot | 310/105 |
| 3,759,512 | 9/1973 | Yount | 272/58 |
| 3,831,942 | 8/1974 | Del Mar | 310/105 |
| 3,966,201 | 6/1976 | Mester | 272/72 |
| 4,188,030 | 2/1980 | Hooper et al. | 272/73 |
| 4,463,945 | 8/1984 | Spector | 272/73 |
| 4,479,646 | 10/1984 | Chirapozu | 272/73 |
| 4,537,396 | 8/1985 | Hooper | 272/130 |
| 4,678,184 | 7/1987 | Neiger | 272/132 |

FOREIGN PATENT DOCUMENTS

| | | | |
|---|---|---|---|
| 923517 | 3/1973 | Canada | 272/132 |
| 0193286 | 9/1986 | European Pat. Off. | 272/73 |
| 2160431 | 12/1985 | United Kingdom | 272/73 |

*Primary Examiner*—Richard J. Apley
*Assistant Examiner*—S. R. Crow

[57] ABSTRACT

A highly compact and lightweight exercise machine which, in one unit, includes the features of a bicycle ergometer and of a rope pulling machine. The resistance to the movement of the bicycle ergometer and rope pulling machine features is provided by the same resistance apparatus. The resistance apparatus includes a metallic disk which is connected to the bicycle ergometer and rope pulling features and which rotates near a source of magnetism. The interaction between the rotating disk and the source of magnetism creates electromagnetic forces which exert drag on the disk. The exercise machine is constructed so that all rotatable components require only two shafts, which construction significantly reduces the space requirements of the exercise machine components. A differential pulley system is incorporated in the exercise machine and amplifies the resistance produced by the resistance apparatus. The exercise machine also includes a system for measuring rotational velocity and/or force caused by a user of the exercise machine.

11 Claims, 6 Drawing Sheets

EXERCISE MACHINE

BACKGROUND OF THE INVENTION

1. Field of the Invention

The present invention relates generally to exercise machines for physical fitness or rehabilitation, and, more particularly, to a light weight, compact combination pedalling and pulling/rowing exercise device.

2. Description of the Prior Art

Exercise machines which, in one form or another, provide resistance to the movement of various muscular groups are known in the art. In recent years, the renewed emphasis on physical fitness has caused a number of new exercise machines to be developed. These machines range from simple springs having handles on either end to sophisticated electronic machines such as are found in selected health spas. The present invention satisfies a need which, notwithstanding the prolific development in the art, still exists in the field of exercise machines. This novel exercise machine has the features of a bicycle ergometer as well as features for resisted rope pulling, the two features which maximize an exercise machine's adaptability to various exercise types. In addition, and perhaps most significantly, the exercise machine of the present invention is of a size considerably smaller than exercise machines presently available, even those having far fewer desirable features.

U.S. Pat. Nos. 3,759,512, issued to Yount, et al.; 3,966,201, issued to Mester; 4,188,030, issued to Hooper (Hooper I); 4,463,945, issued to Donald Spector; 4,479,646, issued to Chirapozu; and 4,537,396, issued to Hooper (Hooper II) are indicative of the present state of the relevant art. Yount, Mester, and Hooper I teach exercise machines which, like the present invention, include the features of a bicycle ergometer. Such machines provide pedals, like a bicycle, the movement of which is resisted by various types of resistance apparatuses.

Many of the presently available exercise machines provide features for more than one type of exercise. Yount, Mester and Hooper I, for example, each have levers attached in various ways for exercising the arms and/or the upper body. The present invention also has exercise features in addition to those of a bicycle ergometer, but utilizes common components for both exercise features to a far greater degree than any of the machines of the prior art.

Also having a common feature with the present invention is Hooper II, as reflected in U.S. Pat. No. 4,537,396, which teaches an exercise machine having a repetitive resisted rope pulling feature. This machine, however, has no integral features for exercising not using a pulling action.

As well as having features which limit the machine's applicability to a narrow range of exercise types, the above described exercise machines share a further undesirable characteristic; that is, they are all of a size and weight which preclude their use in environments having size and/or weight limitations. All of the above-described exercise machines are of a size at least as large as a small bicycle, and the rope pulling module of Hooper II is even larger.

As the above discussion suggests, the prior art does not teach a single exercise machine which combines features for resisted rope pulling and for resisted pedalling. Further, the exercise machines which might possibly be adapted to such a combination of exercises are of considerable size and weight. Finally, those exercise machines which have features for more than a single type of exercise, unlike the present invention, usually involve completely independent mechanisms which simply share a common frame.

As will be apparent to those skilled in the art, the present invention provides a solution to each of the just-referenced limitations of exercise machines of the prior art.

SUMMARY OF THE INVENTION

It is an object of the present invention to provide an exercise machine which combines, in a single unit, features for exercises involving pulling against resistance and features for exercises involving pedalling against resistance.

It is another object of the present invention to provide an exercise machine which combines, in a single unit, features for exercises involving pulling against resistance and features for exercises involving pedalling against resistance, and which, without limiting utility or durability, is of a size and weight for easy transportation and incorporation of the machine into environments having spatial and/or weight related limitations.

It is yet another object of the present invention to provide an exercise machine providing resistance which is variable and measurable in precise gradations.

The present invention teaches a small and lightweight exercise machine which, in one unit, includes features for exercises involving pedalling against resistance as well as features for exercises, such a rowing, which involve pulling against resistance. The exercise machine permits use of its pulling and pedalling features concurrently or independently. The exercise machine includes one or more pairs of sprocket wheels or pulleys which serve as a gear train arranged for enhancing the force produced by a resistance producing apparatus before it is transferred to the pedals and/or rope pull/rowing handles. The resistance producing apparatus, in the preferred embodiment, includes a metallic disk and magnet combination which, upon rotation of the disk, creates electromagnetic forces. The electromagnetic forces serve to resist the rotation of the disk which in turn is connected to the pedals and/or rope pull handle by way of the abovementioned gear train. The exercise machine is constructed in such a manner that all rotatable components requiring a shaft-type support may be mounted on as few as two shafts. This is made possible by the use of bearings in some of the rotatable components which allow components rotating at different velocities to be mounted on a common shaft. A tachometer system for measuring a speed equivalent and/or force exerted by an exerciser is also built into the exercise machine. The tachometer system includes a generator connected to a meter. The meter measures the current produced by the generator and is calibrated to display it in units corresponding to a scale of the manufacturer's choice.

Because the exercise machine is designed using a minimum possible number of components arranged in the most compact manner, the machine is very compact and lightweight.

DESCRIPTION OF THE PREFERRED EMBODIMENT

Figure 1:
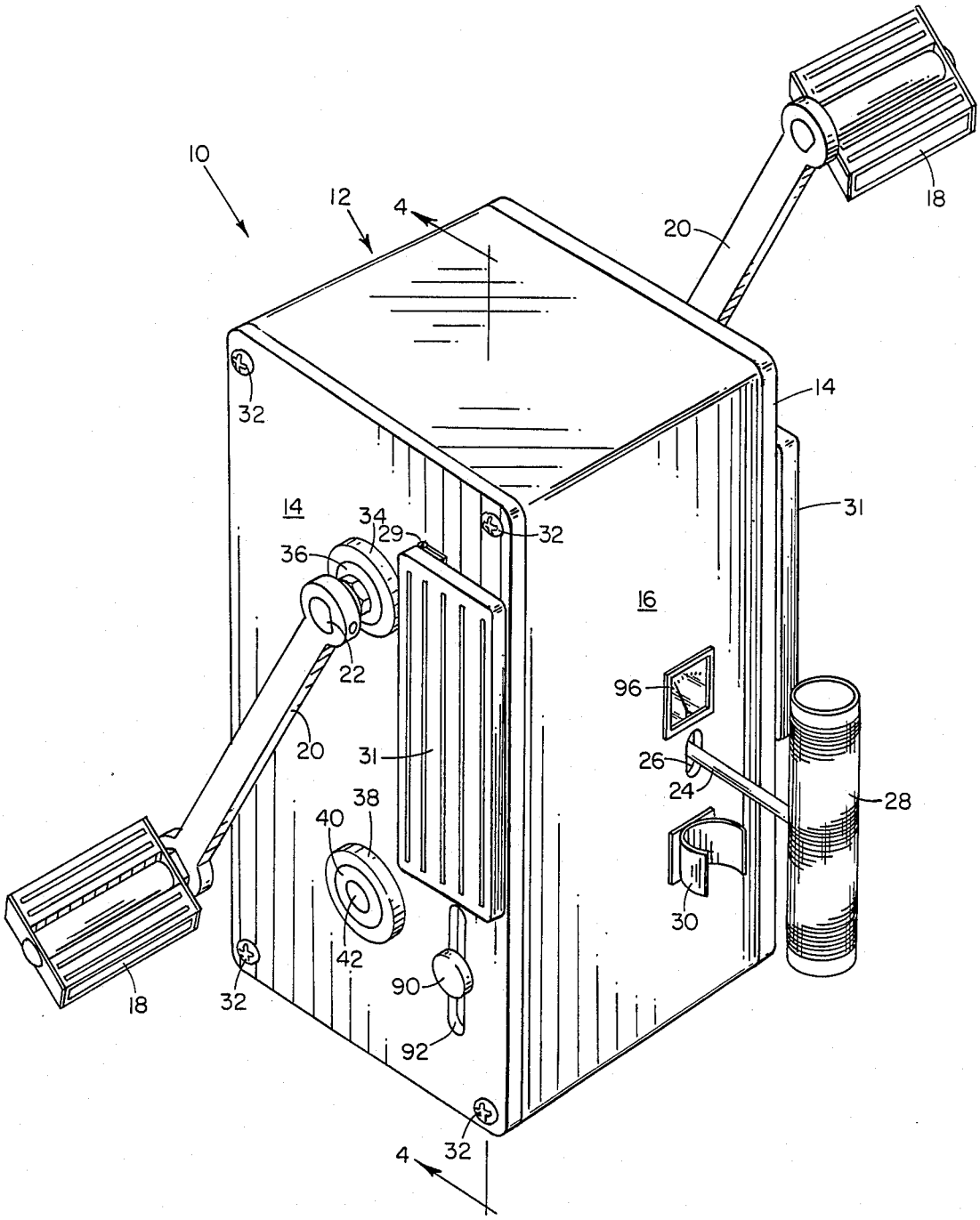
FIG. 1 is a perspective view of the preferred embodiment of an exercise machine.

Referring to FIG. 1, the exercise machine is identified generally by the reference numeral 10. The exercise machine 10 has a housing 12 which in turn has two sidewalls 14 and an intervening enclosure 16. A shaft 22 passes through the housing 12 and extends on either side to the exterior of the exercise machine 10. For pedaling exercises, the exercise machine 10 has two foot pedals 18 mounted upon respective pedal cranks 20. The pedal cranks 20 are mounted on the outside of the exercise machine 10 on the shaft 22 and rigidly affixed thereto by set screws 21.

For exercises based upon pulling against resistance, such as rowing, the exercise machine has a rope 24. An end portion of the rope 24 extends from an opening 26 in the enclosure 16. The remainder of the rope 24 is wound about a rope spool (not shown) inside the housing 12, the function of which will be discussed more fully hereinafter. A handle 28 is attached to the end of the rope 24 which extends through the opening 26. For retaining the handle 28 when not in use, a handle clip 30 is mounted to the same wall of the enclosure 16 that has the opening 26. One foot restraint 31 is mounted on each of side walls 14 by means of a hinge 29 for an exerciser to place his or her feet upon and push against when performing rope pulling exercises such as rowing.

The sidewalls 14 are held to the intervening walls 16 by means of screws 32 which pass through the sidewalls 14 and thread into the enclosure 16. A bearing housing 34 is mounted in each of the sidewalls 14. The bearing housing 34 holds bearings 36 which in turn support the shaft 22 and allow it to rotate freely. A bearing housing 38 containing bearings 40 is also mounted in each of the sidewalls 14 for supporting a second shaft 42. Like the shaft 22, the shaft 42 may rotate freely relative to housing 12.

Figure 2:
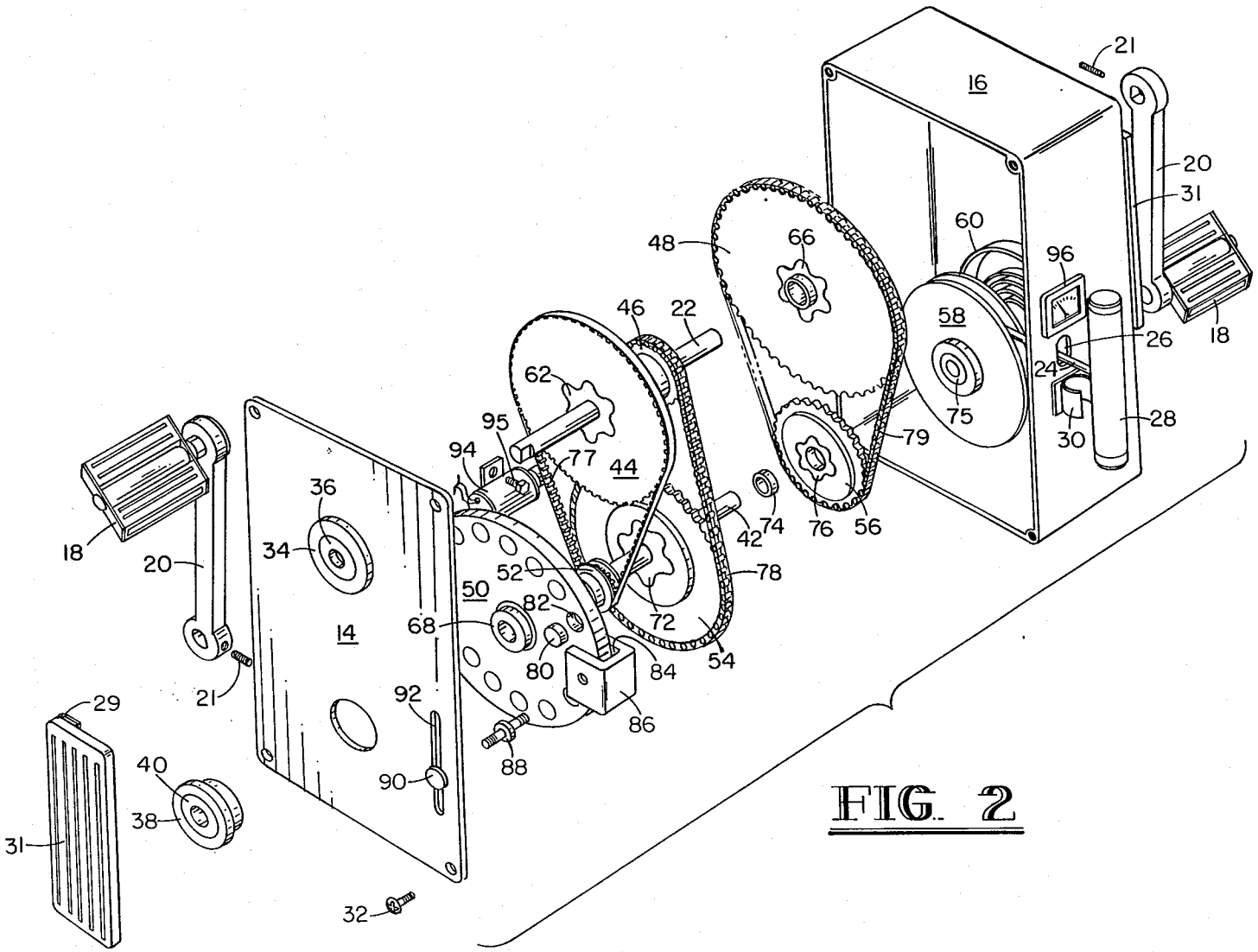
FIG. 2 is an exploded perspective view of the preferred embodiment of the exercise machine.
Figure 3:
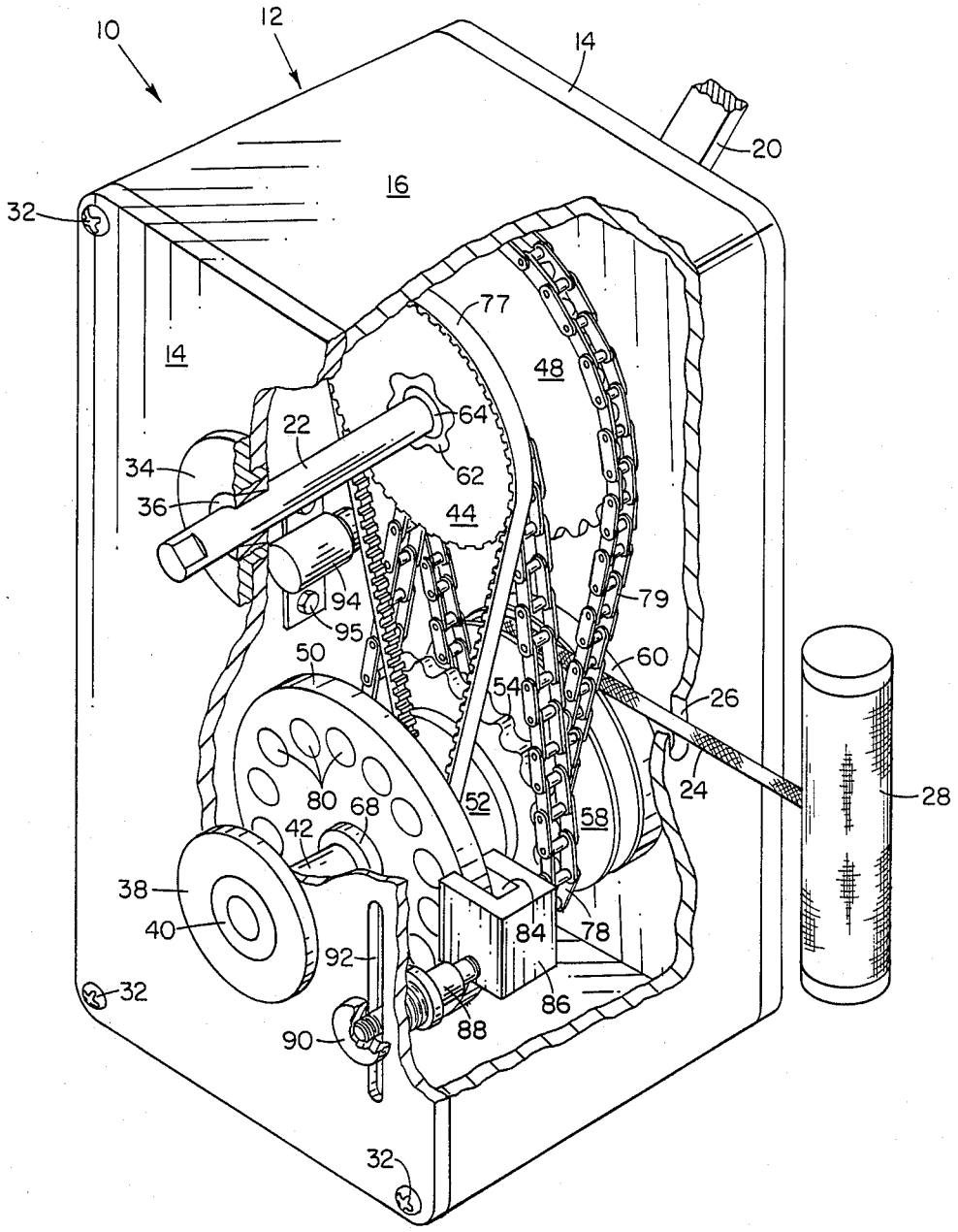
FIG. 3 is a partially sectioned, perspective view of the exercise machine.
Figure 4:
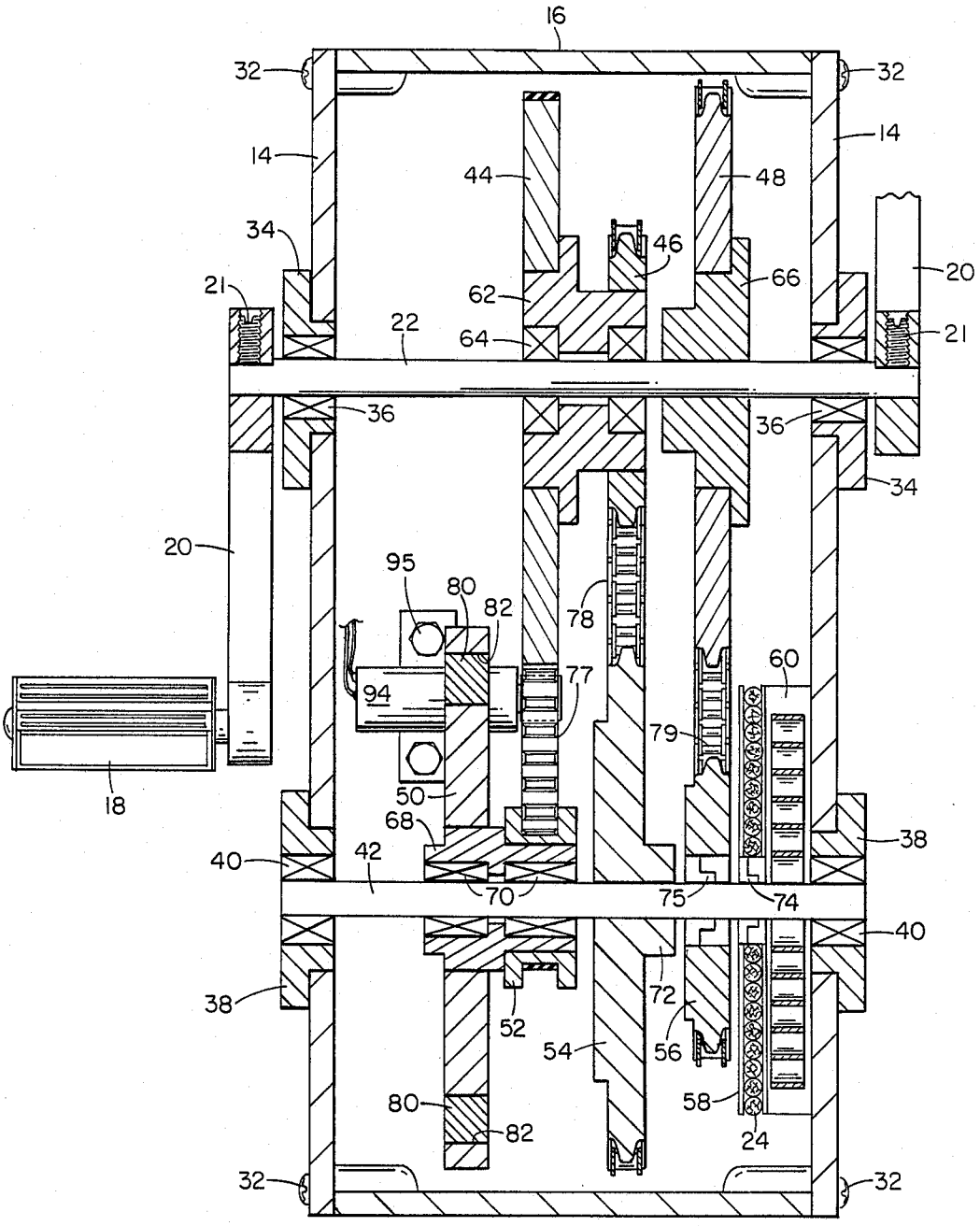
FIG. 4 is a cross-sectional view of FIG. 1 along section line 4—4 as shown in FIG. 1.

Referring to FIGS. 2, 3, and 4 in combination, a timing belt pulley 44 and two sprocket wheels 46 and 48 are placed on the shaft 22 on the inside of the housing 12. A metallic disk 50, a timing belt pulley 52 and two sprocket wheels 54 and 56 are mounted on the shaft 42. A rope spool 58 with an accompanying rewind mechanism 60 is also placed on the shaft 42. The sprocket wheels 44 and 46 share a common shaft mount 62, and therefore must rotate as a unit. Shaft mount 62 has roller bearings 64 which allow the unit consisting of the sprocket wheels 44 and 46 to rotate freely of the shaft 22. The shaft mount 66 of the sprocket wheel 48 is rigidly mounted to the shaft 22, and must rotate as the shaft 22 rotates.

The metallic disk 50 and the timing belt pulley 52 share a common shaft mount 68 and must rotate on the shaft 42 as a unit. The shaft mount 68 has roller bearings 70 which allow the unit consisting of the metallic disk 50 and the timing belt pulley 52 to rotate freely on the shaft 42. The shaft mount 72 of the sprocket wheel 54 is rigidly attached to the shaft 42 and must rotate as the shaft 42 rotates.

A unidirectional clutch 74 is placed within the shaft mount 76 of the sprocket wheel 56, and another unidirectional clutch 75 is placed in the center of the rope spool 58. A chain 78 encircles the sprocket wheels 46 and 54, and a chain 79 encircles the sprocket wheels 48 and 56. A timing belt 77 encircles the timing belt pulleys 44 and 52.

Referring again to FIGS. 2, 3, and 4, the resistance of the exercise machine 10 primarily involves a metallic disk 50 and a U-shaped magnet 86. A U-shaped magnet 86 is held in a static position by an adjustment rod 88. The adjustment rod 88 is mounted through an adjustment slot 92 in one of the side walls 14. An adjustment knob 90 is attached to the end of the adjustment rod 88 which projects to the outside of the exercise machine 10 through the adjustment slot 92. The U-shaped magnet 86 is positioned such that a peripheral portion of the metallic disk 50 passes through the slot 84 of the U-shaped magnet 86 when the metallic disk 50 rotates on the shaft 42. When the metallic disk 50 rotates, the metallic disk 50 and the U-shaped magnet 86 interact and produce eddy currents. The eddy currents exert resistive force on the metallic disk 50. The resistive force is transferred to the pedals 18 and/or to the rope 24 and its handle 28. The sprocket wheels 46, 54, 56, and 66; the timing belt pulleys 44 and 54; the chains 78 and 79; and the timing belt 77 forming the gear train described above operatively connect the resistance apparatus with the pedals 18 and with the rope spool 58.

The metallic disc 50 is, in the preferred embodiment, made of aluminum and has a number of copper plugs 80 which are placed within plug holes 82 which in turn are evenly distributed about the periphery of the metallic disk 50. Such a metallic disk composition best serves the needs of economy by consisting primarily of inexpensive aluminum. The desired magnetic resistance is augmented by the copper plugs 80 because of their conductivity and their peripheral placement on the metallic disk 50.

The degree to which the periphery of the metallic disk 50 passes through the slot 84 of the U-shaped magnet 86 is varied by moving the adjustment rod 88 through the range allowed by the adjustment slot 92. The force produced by the resistance means is therefore easily varied in precise increments by sliding the adjustment rod 88 by the adjustment knob 90.

Alternative embodiments of the present invention may have other devices for producing resistive force other than from electromagnetic interaction. Alternative sources of resistive force include: air displacement, liquid displacement, and mechanical friction.

In order for the gear train consisting of the sprocket wheels and pulleys 44, 46, 48, 52, 54, and 56 to properly multiply the force created by the resistance apparatus, the sprocket wheels or pulleys 44, 54, and 48 must be larger in diameter than their respective counterpart sprocket wheels or pulleys 52, 46, and 56.

For the pulling means to function independently of the pedalling means, and vice-versa, the unidirectional clutch 75 of the rope spool 58 must be oriented such that it engages the shaft 42 upon the rotation of the rope spool 58 which is caused by the pulling of the rope 24 from the exercise machine 10. On the other hand, releasing the rope, with the accompanying reverse rotation of the rope spool 58 has no effect on the shaft 42. Likewise, the unidirectional clutch 74 of the sprocket wheel 56 is oriented such that the rotation of the sprocket wheel 56 (in the same direction as the rotation of rope spool 58 while the rope 24 is being pulled therefrom) causes rotation of the shaft 42. Rotation of the sprocket wheel 56 in the opposite direction has no effect upon the shaft 42. The orientation of the clutches 74 also has the effect of allowing the shafts within the clutches to rotate in one of the two possible directions without engaging the clutch. This allows the rotatable component having the clutch to remain at rest when the shaft rotates in this direction. Therefore, the clutches 74, along with the arrangement of the remaining exercise machine components, allow the pedalling and pulling means to be used independently of each other, notwithstanding the shared use of many of the rotatable exercise machine components.

Referring again to FIGS. 2, 3 and 4, the exercise machine 10 has a system for measuring the velocity of one of the exercise machine components and displaying that velocity in units useful to one using the exercise machine 10. This tachometer system consists of a DC motor 94 which is mounted to the rear wall of enclosure 16 by means of bolts 95 and is electrically connected to a meter 96. The meter 96 is calibrated to display units of velocity or of force depending on the information desired. The armature of the DC motor 94 is frictionally engaged with the timing belt 77 so that upon movement of the timing belt 77 during use of the exercise machine 10, the armature of the DC motor 94 is caused to rotate, electrical current is produced, and the meter 96 reacts proportionate to the amount of current produced.

Figure 6:
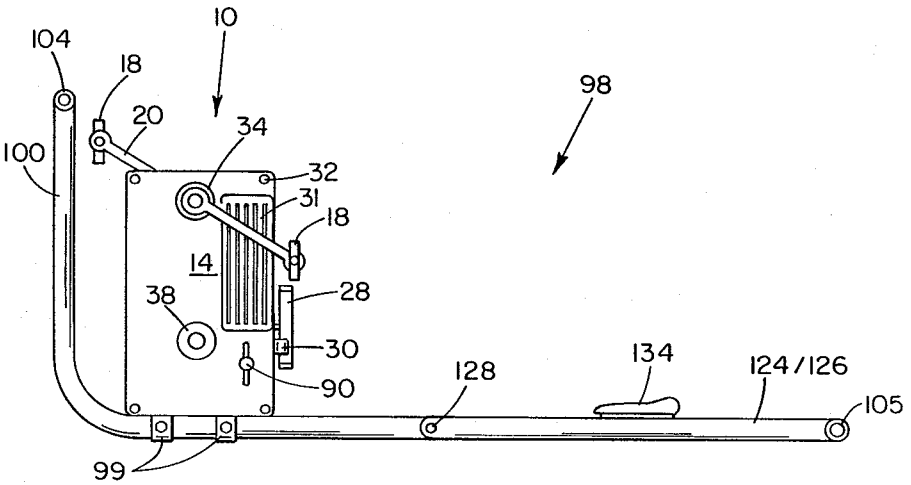
FIG. 6 is a side view of the exercise machine mounted for usage as a rowing machine.
Figure 5:
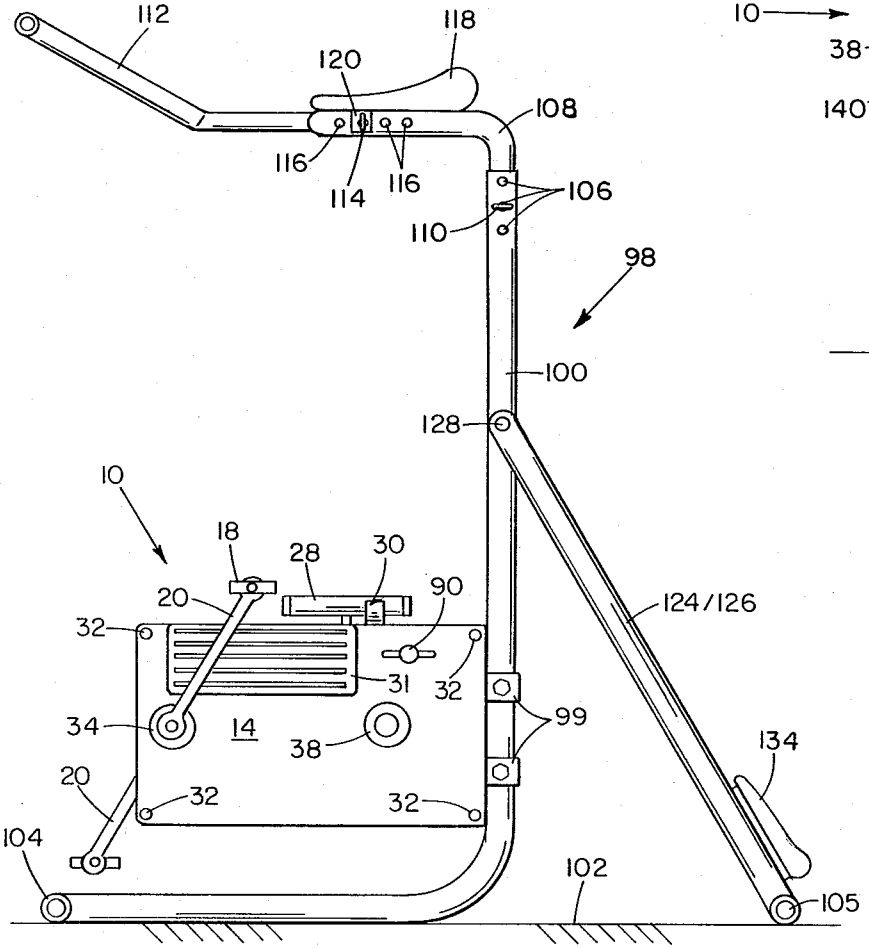
FIG. 5 is a side view of the exercise machine mounted for usage as a bicycle ergometer.
Figure 7:
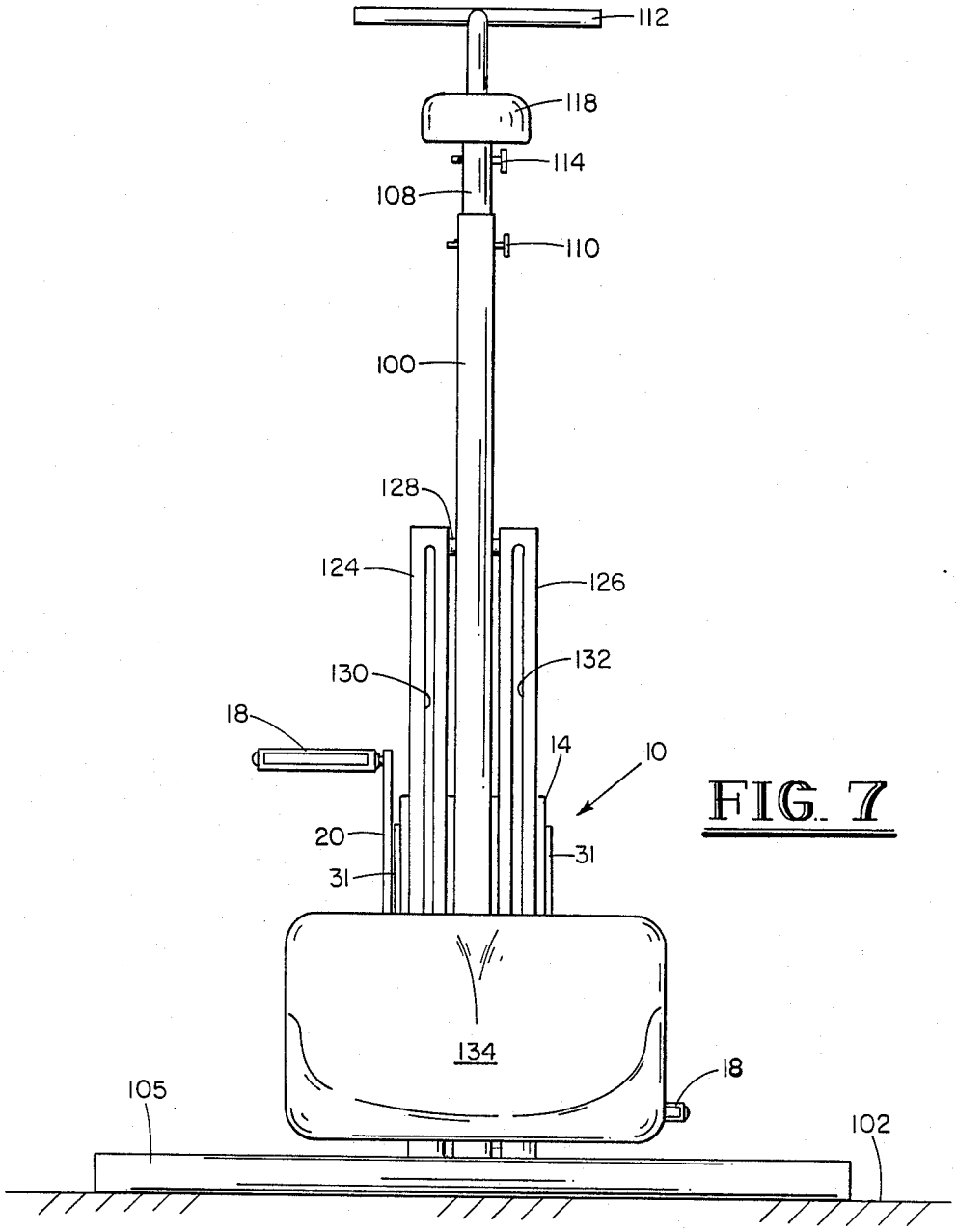
FIG. 7 is a rear view of FIG. 5.

Referring to FIGS. 5 through 7, the exercise machine 10 may be bolted, clamped, or otherwise appropriately mounted to a dual mode frame 98 which permits use of the exercise machine 10 as a bicycle ergometer or as a rowing machine.

FIGS. 5 and 7 illustrate the exercise machine 10 and the frame 98 in the bicycle ergometer mode. In the bicycle ergometer mode, the handle 28 is in its stored position within the handle clip 30.

A dual mode frame 98 comprises a base member 100 which normally rests atop a floor 102. A transverse cross member 104 is connected on one end of the base member 100. The opposite end of the base member 100 is provided with a plurality of seat support adjustment passages 106. A seat support member 108 is telescopically received within the base member 100 when the frame 98 is in the bicycle ergometer mode. The seat support member 108 has a passage therethrough (not shown) which permits upward or downward adjustment of the seat support 108. By inserting a seat support adjustment pin 110 through one of the passages 106 in the base member 100 and the passage through seat support member 108, the seat support is locked into place.

Referring again to FIGS. 5 through 7, an adjustable handle bar 112 is telescopically received within the seat support member 108. The portion of the handle bar 112 within the seat support 108 has a plurality of passages therethrough (not shown) which permit adjustment of the handle bar 112. By inserting an adjustment pin 114 through one of the passages 116 in the seat support 108 and a passage through the portion of the handle bar 112 within the seat support 108, the handlebar is locked into place. An adjustable bicycle seat 118 having a downwardly extending clip 120 connected thereto is connected to the seat support 108. The bicycle seat 118 is connected to the seat support 108 by inserting the adjustment pin 114 through the clip passage 122 in the clip 120, through one of the passages 116 in the seat support member 108, and through the corresponding passage in handlebar 112 in alignment therewith.

Referring again to FIG. 7, a pair of sliding rails 124 and 126 are pivotally connected to the base member 100 at a pivot shaft 128. The sliding rails 124 and 126 have two grooves 130 and 132, respectively, for receiving roller guides (not shown) of a rowing seat 134. The ends of sliding rails 130 and 132 opposite the pivot shaft 128 are connected to a transverse cross member 105 which rests atop floor 102 and provides lateral stability for the frame when in the rowing position.

Referring again to FIG. 6, when the exercise machine 10 and the frame 98 are in the rowing machine or rope pull mode the seat support 108, the handlebar 112, and the bicycle seat 118 are removed and the rails 124 and 126 are pivoted about the pivot shaft 128 and locked into alignment with the base member 100.

Figure 8:
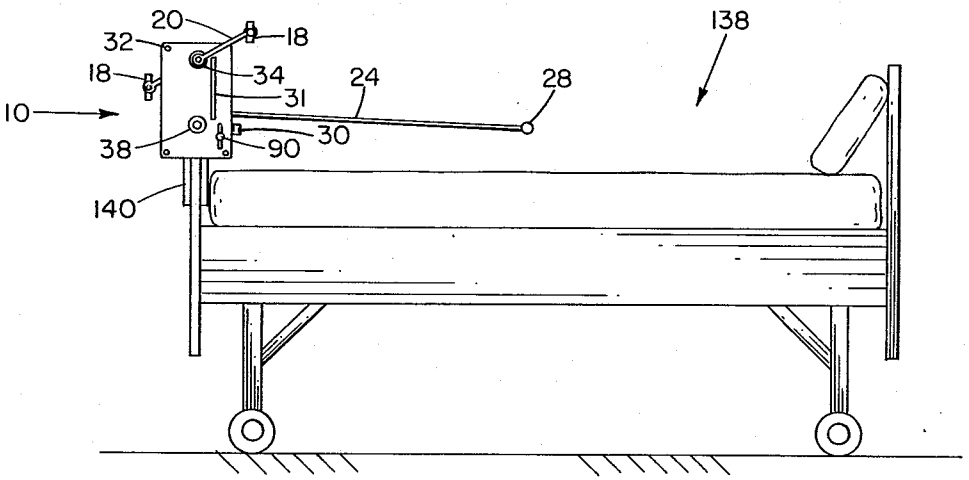
FIG. 8 is a side view of the exercise machine mounted for usage on a hospital or convalescent bed.

As illustrated in FIG. 8, the exercise machine 10 may be mounted to a hospital bed 138 by means of a bracket 140 which is appropriately connected to the housing 12. A patient in need of physical therapy may, therefore, be served without the necessity of being transported to distant facilities. The patient may pull the rope 24 by the handle 28, or even pedal by moving toward the foot of the bed 138.

The exercise machine may also be mounted on a wall or in other places and in different orientations not shown in any of the figures.

It is noted that the components of the exercise machine 10 of the preferred embodiment may be of a size such that the housing 12 is only slightly larger than an average shoe box. Notwithstanding such a size, the exercise machine of the present invention provides benefits equal to devices of significantly larger size. While reduced space requirements are of considerable value in and of themselves, the small size of the components of the exercise machine 10, along with the use of a minimum possible number of components made of the lightest possible material also makes the exercise machine 10 very light in comparison with presently available exercise machines.

Because its size and weight, the exercise machine 10 may be used in environments not conducive to units of the size and/or weight of exercise machines of the prior art. Such applications include installation in space vehicles, sea vessels with limited crew space, larger private airplanes, isolated research facilities in remote areas, and simply any living or working environment where space savings are desired and/or where weight is a consideration.

OPERATION OF THE PREFERRED EMBODIMENT

The operation of the preferred embodiment will now be discussed in detail.

For the purposes of this discussion, the mention of "clockwise direction" and "counterclockwise direction" is that direction corresponding to the orientation shown in FIG. 2.

When the exercise machine 10 is used for pedaling exercises, a user places his or her feet or hands on pedals 18, and proceeds as if pedaling a bicycle. One must pedal in a clockwise direction, as pedaling in a counterclockwise direction would not actuate the gear reduction means, and therefore the resistance means, beyond sprocket wheel 56. The orientation of the unidirectional clutch 74 in sprocket wheel is, as described above, such that sprocket wheel 56, rotating in a counterclockwise direction, does not cause the clutch 74 to engage. Therefore, shaft 42, which must rotate for actuation of the resistance means, remains at rest when the pedals are moved in a counterclockwise direction.

The chain of events leading to the actuation of the resistance means is as follows:

1. The pedals 18, rigidly attached to the shaft 22, are rotated in a clockwise direction;
2. The shaft 22 rotates;
3. The sprocket wheel 48 which is rigidly attached to the shaft 22 rotates;
4. Because of the chain 78 which encircles the sprocket wheels 48 and 56, the sprocket wheel 56 rotates;
5. The clockwise rotation of the sprocket wheel 56 engages the unidirectional clutch 74 and causes the shaft to rotate;
6. The sprocket wheel 54 which is rigidly attached to the shaft 42 rotates;
7. Because of the chain 78 which encircles the sprocket wheels 54 and 46, the sprocket wheel 46 is causes to rotate;
8. Because of its sharing a common shaft mount 62 with the sprocket wheel 46, the timing belt pulley 44 rotates;
9. The timing belt 77 which encircles the timing belt pulleys 44 and 52 causes the timing belt pulley 52 to rotate;
10. Because of its sharing a shaft mount 68 with the timing belt pulley 52, the metallic disk 50 rotates;
11. Rotation of the metallic disk 50 is resisted by the eddy currents which are produced by passage of the periphery of the metallic disk 50 through the slot 84 of the U-shaped magnet 86. Therefore, the pedaling by an exerciser is resisted.

When the rope pulling means is used, the chain of events leading to the actuation of the resistance means is as follows:

1. A user grasps the handle 28, or anything variation appropriately attached thereto, and thereby pulls the rope 24 outward from the exercise machine 10;
2. The rope spool 58 rotates in a clockwise direction because of the manner in which the rope 24 has been wound onto the rope spool 58;
3. The unidirectional clutch 75 of the rope spool 58 engages and causes the shaft 42 to rotate along;
4. The sprocket wheel 54 which is rigidly attached to the shaft 42 rotates;
5. Because of the chain 78 which encircles the sprocket wheels 54 and 46, sprocket wheel 46 is causes to rotate;
6. Because of its sharing a common shaft mount 62 with sprocket wheel 46, the timing belt pulley 44 rotates;
7. The timing belt 77 which encircles the timing belt pulleys 44 and 52 causes pulley 52 to rotate;
8. Because of its sharing a shaft mount 68 with the timing belt pulley 52, the metallic disk 50 rotates;
9. Rotation of the metallic disk 50 is resisted by the eddy currents which are produced by passage of the periphery of the metallic disk 50 through the slot 84 of the U-shaped magnet 86. The pulling of the rope 24 by an exerciser is resisted;
10. After the rope 24 is fully extended, the user allows the rope to be drawn back into the exercise machine 10 by the rope spool which rotates in a counterclockwise direction because of the rewind mechanism 60 associated therewith. The counterclockwise rotation of the rope spool 58 does not affect the shaft 42, or anything associated therewith, because the unidirectional clutch does not engage when rotating in a counterclockwise direction relative to the shaft 42 as described above.

When the exercise machine 10 has been mounted on a dual mode frame 98 and is in the rowing position as shown in FIG. 6, the following steps are taken:

1. The exerciser sits upon the seat 134;
2. The feet are placed against the foot stops 31 on either side of the exercise machine 10;
3. The legs are flexed so that the exerciser draws the body near the exercise machine 10 which is allowed by the sliding of the seat 134 in the grooves 130 and 132 of the rails 124 and 126;
4. The handle 28 is grasped;
5. The legs are extended and the arms are flexed thereby pulling the handle 28 from the exercise machine 10 until the legs are fulling extended and the arms fulling flexed;
7. The exerciser returns to the starting position and the process is repeated.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is therefore contemplated that the appended claims will cover such modifications that fall within the scope of the invention.

I claim:

1. An exercise machine for providing rope pull/rowing exercise and bicycling exercise comprising:

a housing;

shaft means extending through said housing and being rotatably carried by said housing;

bicycle pedal means rigidly attached to said shaft means external to said housing;

rope pulling means rotatably connecting to said shaft means, said rope pulling means extending external to said housing;

resistance means mounted in said housing and operatively connected to said shaft means to resist rotation of said shaft means;

clutch means for rotatably connecting said shaft means to provide for said rope pulling/rowing exercise from said rope pulling means and said bicycling exercise from said bicycle pedal means; and gear reduction means connected to said shaft means linking said rope pulling means and said bicycle pedal means with said resistance means and including at least one pair of rotating components having unequal diameters, said gear reduction means allowing said resistance means to apply appropriate force for proper exercise by said rope pull/rowing exercise and said bicycling exercise when in use.

2. An exercise machine for providing rope pull/rowing exercise and bicycling exercise comprising:

a housing;

shaft means extending through said housing and being rotatably carried by said housing, said shaft means comprising a first shaft extending through said housing and a second shaft generally parallel to said first shaft;

bicycle pedal means rigidly attached to said shaft means external to said housing;

rope pulling means rotatably connecting to said shaft means, said rope pulling means extending external to said housing;

resistance means mounted in said housing and operatively connected to said shaft means to resist rotation of said shaft means;

clutch means for rotatably connecting said shaft means to provide for said rope pulling/rowing exercise from said rope pulling means and said bicycling exercise from said bicycle pedal means; and gear reduction means connected to said shaft means linking said rope pulling means and said bicycle pedal means with said resistance means and including at least one pair of rotating components having unequal diameters, a first said rotating component of said pair being mounted upon said first shaft and a second said rotating component of said pair being mounted upon said second shaft, said first and second rotating components being coupled together for transferring rotation between said first and second rotating components of said pair.

3. An exercise machine for providing rope pull/rowing exercise and bicycling exercise comprising:

a housing;

shaft means extending through said housing and being rotatably carried by said housing;

bicycle pedal means rigidly attached to said shaft means external to said housing;

rope pulling means rotatably connecting to said shaft means, said rope pulling means extending external to said housing;

resistance means mounted in said housing and operatively connected to said shaft means to resist rotation of said shaft means;

clutch means for rotatably connecting said shaft means to provide for said rope pulling/rowing exercise from said rope pulling means and said bicycling exercise from said bicycle pedal means, said clutch means comprising at least one unidirectional clutch oriented in a manner for operation of said bicycle pedal means independently of said rope pulling means, as well as operation of said rope pulling means independently of said bicycle pedal means; and gear reduction means connected to said shaft means linking said rope pulling means and said bicycle pedal means with said resistance means and including at least one pair of rotating components having unequal diameters and being coupled together, said pair of said rotatable components of said gear reduction means being mounted on said shaft means.

4. An exercise machine usable for exercises involving pedalling against resistance and pulling against resistance comprising:

a housing;

a first shaft extending through said housing, said first shaft being rotatably carried by said housing;

a second shaft rotatably carried by said housing;

resistance means operatively engaged with said first shaft and said second shaft for resisting rotation of said first and said second shafts; said resistance means being mounted at least in part to said housing;

pedalling means mounted outside of said housing and attached to said first shaft for imparting rotation to said first shaft;

pulling means attached to said second shaft for imparting rotation to said second shaft, said pulling means having means for grasping positioned externally to said housing;

gear reduction means mounted on said first and second shafts for coupling said pedalling means with said resistance means, for coupling said pulling means with said resistance means, and for enhancing a resistance produced by said resistance means;

bearing members for said first and second shafts for allowing rotation of said pedalling means and said pulling means on said first and second shaft; and unidirectional clutches for connecting said pedalling means and said pulling means on said first and second shafts upon rotation in a first direction, but releasing upon rotation in a second direction.

5. An exercise machine as disclosed in claim 4 wherein:

said resistance means includes a metallic disk rotatably mounted on either said first or second shaft, a source of magnetism mounted in said housing in proximity to said metallic disk for creating eddy currents upon rotation of said metallic disk, and mounting means for maintaining said source of magnetism in said proximity;

said pedalling means includes pedal cranks having pedals mounted on opposite ends of said first shaft which ends project through said housing to a space outside of said housing;

said gear reduction means includes at least one pair of rotating components having unequal diameters, a first rotating component of said pair being mounted upon said first shaft and a second rotating component of said pair being mounted upon said second shaft, said first and second rotating components being coupled together for transferring rotation between said first and second rotating components of said pair;

said bearings members are included within mounting means of said rotating components of said gear reduction means whereby rotation of said rotating component is independent of said first or second shaft upon which said rotating component is mounted; and unidirectional clutches are arranged in a manner whereby actuation of said pedaling means is independent of said pulling means, and whereby actuation of said pulling means is independent of said pedalling means.

6. An exercise machine as disclosed in claim 5 wherein said metallic disk is an aluminum disk rotatably mounted upon said first or second shaft, a plurality of copper plugs being mounted within plug holes placed peripherally through said aluminum disk, said source of magnetism being a U-shaped magnet having a slot, said U-shaped magnet being maintained in a position whereby a peripheral portion of said aluminum disk passes through said slot upon rotation of said aluminum disk.

7. An exercise machine as disclosed in claim 5 said pulling means includes a rope, a first end of said rope being attached to a rope spool, said rope being partially wound about said rope spool, a second end of said rope being attached to a handle located outside of said exercise machine, said rope spool having one of said unidirectional clutches therein for imparting rotation to said second shaft upon which said rope spool is mounted when said rope spool turns in a first direction in response to pulling of said rope by a user of said exercise machine, said rope spool being coupled with a rewind mechanism for rewinding said rope upon said rope spool upon release by said user.

8. An exercise machine as disclosed in claim 5 further comprising:

a second rope spool mounted in like manner to first said rope spool;

a second rewind mechanism coupled with said second rope spool;

a second rope wound about and attached by a first end to said second rope spool; and a second handle attached external to said housing to a second end of said second rope.

9. An exercise machine as disclosed in claims 4, 5, 6, 7 or 17 further comprises means for measuring velocity of a moving component of said exercise machine and indicating said velocity to a user of said exercise machine, said means for measuring and indicating being mounted to said housing.

10. An exercise machine as disclosed in claim 9 wherein velocity measuring means comprises:

means for generating electricity in proportion to movement of said components of said exercise machine; and means for indicating an amount of said electricity generated in significant terms, said means for indicating being electrically connected to said generating means.

11. The exercise machine as disclosed in claim 4 further comprises pivoted foot rest pivotally mounted to said housing; said pivotal foot rest being used during said pulling exercise by a user.

* * * * *